US008317365B2

(12) United States Patent
Tracy et al.

(10) Patent No.: US 8,317,365 B2
(45) Date of Patent: Nov. 27, 2012

(54) FLUORESCENT BULB COVER

(76) Inventors: Lisa Tracy, Canton, GA (US); William Tracy, Canton, GA (US)

( * ) Notice: Subject to any disclaimer, the term of this patent is extended or adjusted under 35 U.S.C. 154(b) by 289 days.

(21) Appl. No.: 12/750,199

(22) Filed: Mar. 30, 2010

(65) Prior Publication Data

US 2011/0242823 A1 Oct. 6, 2011

(51) Int. Cl.
*F21S 8/00* (2006.01)

(52) U.S. Cl. ..... 362/268; 362/351

(58) Field of Classification Search ..... 362/546, 362/549, 363, 650, 264, 294, 268, 297–300, 362/310, 311.01, 311.06, 335, 351, 307
See application file for complete search history.

(56) References Cited

U.S. PATENT DOCUMENTS

| | | | | | |
|---|---|---|---|---|---|
| 486,729 | A | | 11/1892 | Miller | |
| 2,134,356 | A | | 10/1938 | Clemence | |
| 2,231,481 | A | | 2/1941 | Rogers et al. | |
| 2,714,652 | A | | 8/1955 | Meyer | |
| 2,749,432 | A | | 6/1956 | Dorsey | |
| 2,851,439 | A | | 9/1958 | Clark | |
| 3,757,105 | A | | 9/1973 | McCarthy | |
| 3,974,373 | A | | 8/1976 | Zapolsky | |
| 4,074,165 | A | | 2/1978 | Moriyama | |
| 4,117,532 | A | * | 9/1978 | Arbib | 362/358 |
| 4,363,083 | A | | 12/1982 | Tanaka et al. | |
| 4,564,890 | A | | 1/1986 | Poyer | |
| 4,787,018 | A | | 11/1988 | Poyer | |
| 4,816,970 | A | * | 3/1989 | Garcia, Jr. | 362/183 |
| 4,833,580 | A | | 5/1989 | Allen | |
| 4,847,741 | A | | 7/1989 | Boettinger | |
| 4,878,159 | A | | 10/1989 | Blaisdell et al. | |
| 4,987,524 | A | * | 1/1991 | Miller | 362/355 |
| 5,124,900 | A | * | 6/1992 | Varey et al. | 362/352 |
| 5,132,886 | A | | 7/1992 | Hoag et al. | |
| 5,309,342 | A | | 5/1994 | Heinen, Sr. | |
| 5,359,506 | A | | 10/1994 | Koleno | |
| 5,546,291 | A | | 8/1996 | Simes | |
| 5,567,045 | A | * | 10/1996 | Bucek | 362/363 |
| 5,738,437 | A | | 4/1998 | Ilagan | |
| 5,918,967 | A | | 7/1999 | Land | |
| 5,951,148 | A | | 9/1999 | Limber | |
| 6,296,375 | B1 | | 10/2001 | Sung et al. | |
| 6,361,192 | B1 | | 3/2002 | Fussell et al. | |
| 6,502,962 | B1 | | 1/2003 | Menke et al. | |
| 6,511,204 | B2 | | 1/2003 | Emmel et al. | |
| 6,558,015 | B1 | * | 5/2003 | Marmaropoulos et al. | 362/84 |
| 6,558,022 | B2 | * | 5/2003 | Kawahara | 362/257 |
| 7,021,787 | B1 | * | 4/2006 | Kuelbs | 362/183 |
| 7,048,414 | B2 | | 5/2006 | Weber | |
| 7,125,159 | B2 | | 10/2006 | Hirsch et al. | |
| 7,325,942 | B2 | | 2/2008 | Chang | |
| 2003/0161149 | A1 | | 8/2003 | Eaton, Jr. | |

(Continued)

*Primary Examiner* — Julie Shallenberger
(74) *Attorney, Agent, or Firm* — McHale & Slavin, P.A.

(57) ABSTRACT

Disclosed is a cover for a compact fluorescent light employing a two piece clamshell shape assimilating a conventional incandescent light bulb. The cover is formed from two clamshells hingedly secured along a top end having inter-engaging means for securing one clamshell to a second clamshell tightly securing the cover to the base of a compact fluorescent light. In the preferred embodiment, the housing is made of material to reduce or eliminate ultraviolet light produced from a gas discharge lamp and provide a cover that can be decorative through the emulation of a conventional incandescent light bulb or decorated with colors and materials wherein the fluorescent light provides back lighting or where images are placed upon the housing so as to allow the back lighting to operate as a projection surface placing images on a wall separate from the light bulb.

14 Claims, 2 Drawing Sheets

U.S. PATENT DOCUMENTS

2004/0095768 A1* 5/2004 Watanabe et al. ..... 362/337
2004/0218400 A1* 11/2004 Egashira ..... 362/520
2007/0052376 A1* 3/2007 Lee ..... 315/312
2011/0044055 A1* 2/2011 Singer ..... 362/311.01

* cited by examiner

FLUORESCENT BULB COVER

FIELD OF THE INVENTION

This invention relates generally to field of fluorescent lighting and, more specifically, to a fluorescent light bulb cover capable of providing a decorative appearance emulating a conventional incandescent light bulb.

DESCRIPTION OF THE PRIOR ART

Incandescent lighting is based upon the heating of a filament into a white-hot condition thereby producing visible light. A large portion of the energy used to create the heat the filament is loss as heat. In addition to the poor efficiency of the conventional incandescent electric light bulb, conventional light bulbs employ a fragile filament within a fragile enclosure.

Fluorescent lighting is more energy-efficient than conventional incandescent lighting and for this reason has a great market appeal. Fluorescent lighting is based upon a gas discharge lamp that uses electricity to excite mercury vapor. The excited mercury atoms produce short-wave ultraviolet light that causes a phosphor to fluorescence producing visible light. Because fluorescent bulbs don't use heat to create light, they are far more energy-efficient than regular incandescent bulbs.

The fluorescent bulbs were typically the long tube type but more recently have been reduced to the size of an incandescent bulb, most notably are the twister style compact fluorescent bulbs. Unfortunately the fluorescent bulbs emit ultraviolet light which may be hazardous to some people. When used inside of a building the ultraviolet light is a form of concentrated radiation that can cause fading of colors and can affect certain plastics causing them to become brittle. Ultraviolet light is also known to aggravate, if not trigger, certain autoimmune symptoms such as lupus or inflammatory diseases such as rosacea.

The shape of the compact fluorescent bulb, although functional, is considered by some to be modern and by others to be unsightly. Between the non-traditional shape and the different light produced, many consumers simply do not accept the high efficiency fluorescent bulb. Accordingly, the consuming public has not readily accepted the new style bulb for all of their lighting needs.

The use of a cover over a light bulb is known in the art. For instance, U.S. Pat. Nos. 2,134,356; 2,231,481; 2,714,652; 2,749,432; 2,851,439; 3,757,105; 4,833,580; 4,847,741; 5,359,506 and 5,918,967 disclose decorative covers for placement over small incandescent bulbs. The decorative aspects of such devices are based on the use of paint, transparencies, or shape to obtain a decorative appeal. These have been used with a certain degree of success but limited to low wattage light bulbs.

Covers have also been placed over larger fixtures in the shape of transparent and translucent covers, globes, and the like. For instance, U.S. Pat. No. 5,567,045 which discloses a decorative cover that can be placed around a carriage lamp.

U.S. Pat. No. 3,974,373 discloses a lamp fixture having a specially formed base and cover. The cover is generally conventional, having an outwardly extending flange around the base. The fixture base provides multiple locations for the mounting of a pair of opposed clips, which extend into the interior of the cover.

U.S. Pat. No. 4,787.018 discloses a fluorescent lamp mounted on a flat circular base and having a cylindrical frosted cover or lens and a domed end cap, the cover being retained on the base by friction and gravity.

U.S. Pat. No. 5,309,342 discloses a lighting fixture incorporating a circular peripheral frame that holds a circular translucent plate for a flush mounted lighting fixture. The frame includes a plurality of tabs extending upwardly therefrom, which engage corresponding slots in the fixture body or reflector.

U.S. Pat. No. 5,738,437 discloses a light fixture wherein a plurality of pivotable retainers is secured to a fixture base. The fixture has an outwardly extending helical flange around the base of the cover and a mating helical channel within the light fixture base. The flange and channel each form only a single pitch and extend around their respective components only 360 degrees, thereby allowing the fixture cover to be removed from or installed upon the fixture base with only a single turn.

U.S. Pat. No. 5,546,291 discloses a conversion kit assembly for use with a light bulb such as a compact fluorescent bulb provides the light bulb with the appearance of a different type of bulb as well as the ability to adjust the illumination by varying the position of the conversion kit assembly on the light bulb. The conversion kit assembly includes a collar having a hollow interior for receiving the light bulb and resilient prongs for engaging the light bulb to maintain the collar in a desired mounted position on the light bulb. The glass envelope has the shape and appearance of a particular type of light bulb, so that a compact fluorescent bulb can assume the appearance of a floodlight, a spotlight or a rounded globe.

U.S. Pat. No. 6,296,375 discloses a compact fluorescent lamp including a housing for enclosing a ballast and, optionally, a starter; a fluorescent light tube attached to the housing and electrically connected to the ballast; and a base electrically connected to the ballast and physically attached to the housing for connecting the lamp to an electrical receptacle. The housing is provided at an upper edge thereof with male or female mating elements. The lamp further includes a translucent cover or shroud for surrounding the fluorescent tube, having a closed form and being open at an end thereof, and being provided at the open end with male or female mating elements cooperative with the mating elements on the housing to directly, positively, and detachably attach the cover to the housing.

U.S. Pat. No. 7,048,414 discloses a light fixture cover system in which the selectively detachable cover is also a unitary structure including a body having a peripheral sealing lip that fits over any corresponding industry standard outside light fixture. The sealing lip of the cover has at least one laterally extending tab member to assist in removing the cover from the fixture.

While the shape of a conventional incandescent bulb is traditional, they remain a source of heat and thus are not very energy efficient. A drawback of compact fluorescent lamps in general is the somewhat lower radiance output than from incandescent bulbs of comparable size. While fluorescent lamps having a conventional threaded base for insertion into a standard threaded light bulb socket, the similarity in operation ends at that point. To the knowledge of the present inventor, no one has developed a selectively detachable cover that is securable to a fluorescent bulb for use in providing the consumer with a cover that can be decorated, protects from UV light, and resembles a conventional incandescent bulb.

SUMMARY OF THE INVENTION

A compact fluorescent light bulb cover formed from a housing having a generally hemispherical shape emulating a conventional incandescent light bulb. The housing is formed from two clamshell shaped sections that are hinged together for ease of installation and removal. Each clamshell includes a interengaging tab projecting therefrom forming shaped section recesses for complementary positioning within recesses of the adjoining clamshell section. The housing further includes a peripheral resealable lip conforming to the outer perimeter of a lamp fixture.

The housing may include a lip or a rubberized continuous resilient seal for frictionally engaging the base of the compact fluorescent light bulb to prevent the housing from moving. The housing material preferably includes a UV inhibitor to reduce or eliminate the emission of ultraviolet light. The outer surface of the housing may includes a texture for receipt of indicia.

An objective of the instant invention is to provide a cover for use with compact fluorescent light bulbs that emulate a conventional incandescent light bulb.

Yet another objective of this invention is to provide a cover that reduces or eliminates the ultraviolet light produced by a compact fluorescent light.

Still another objective of the instant invention is to provide a housing capable of shielding the glass tubing of a fluorescent light from impact damage.

Still another objective of the instant invention is to provide a cover that will contain the glass fragments of a fluorescent light bulb that has been breached.

Still another objective of the instant invention is to provide a coating on the interior surface of a cover so as to allow uniform distribution of light throughout the length of the cover.

Still another objective of the instant invention is to provide a housing having an exterior surface that is receptive to the placement of indicia.

Other objectives and advantages of this invention will become apparent from the following description taken in conjunction with the accompanying drawings wherein are set forth, by way of by way of illustration and example, certain embodiments of the invention. The drawings constitute a part of this specification and include exemplary embodiments of the present invention and illustrate objects and features thereof.

DETAILED DESCRIPTION OF THE PREFERRED EMBODIMENT

Figure 3:
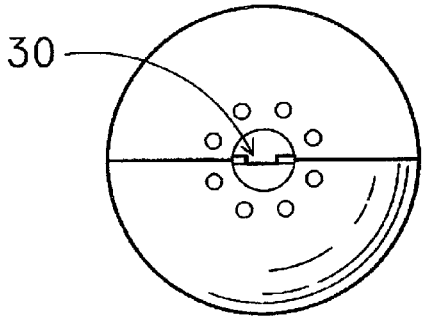
FIG. 3 is a top view thereof.
Figure 2:
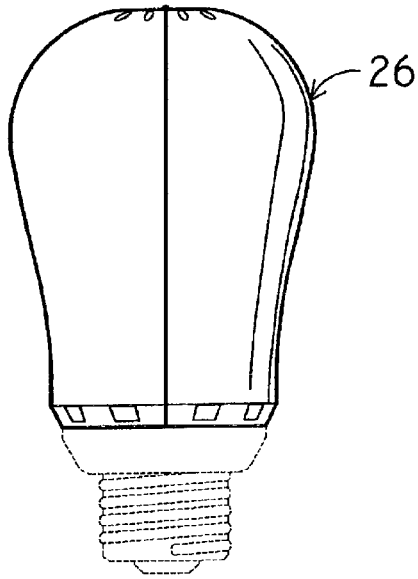
FIG. 2 is a side view thereof.
Figure 1:
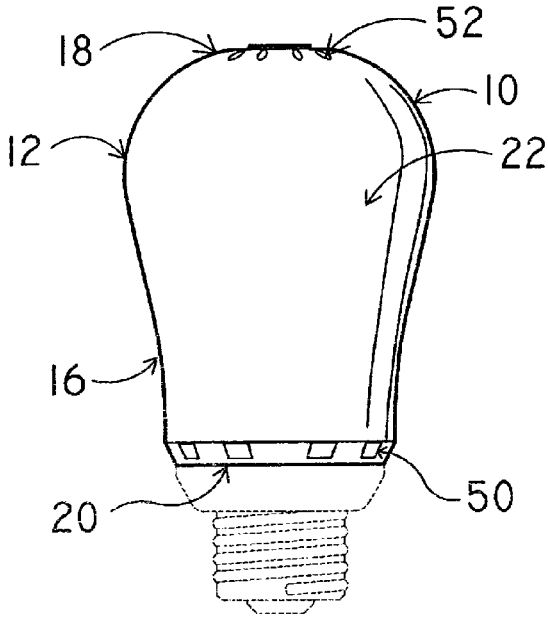
FIG. 1 is a plane view of the cover for the compact fluorescent light.
Figure 4:
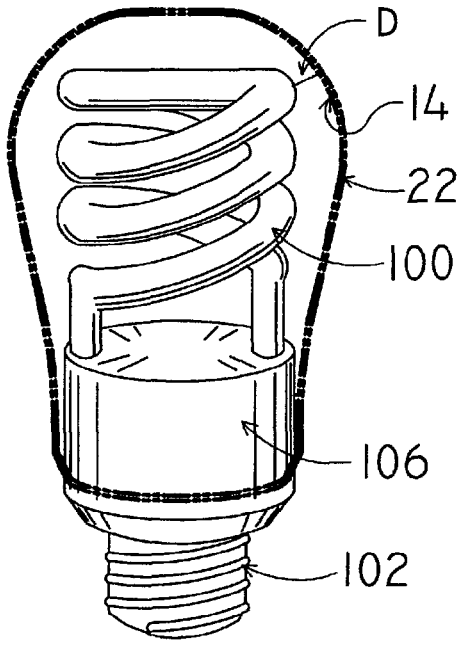
FIG. 4 is an perspective view thereof.
Figure 5:
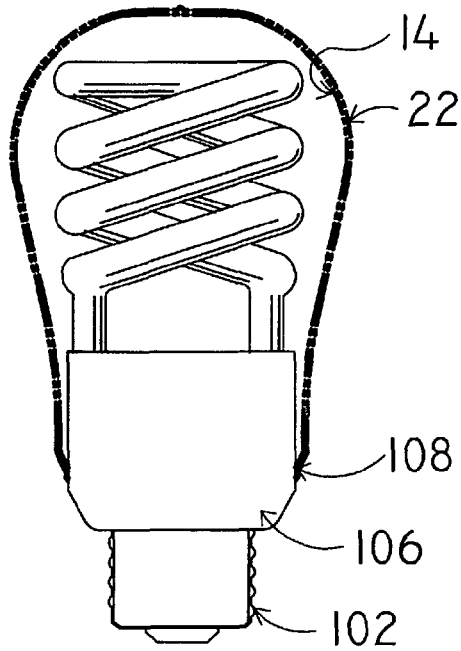
FIG. 5 is a side view illustrating the housing in a cross sectional view.
Figure 6:
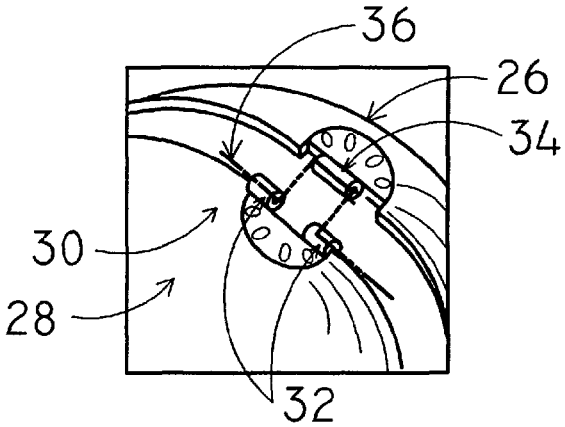
FIG. 6 is an enlarged prospective view of the hinge.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Now referring to the drawings in general, set forth is a cover for use with compact fluorescent light bulbs. The cover is formed from a rigid plastic housing 10 having an upper section 12 defined by a generally hemispherical shape. The upper section defines an interior 14 sized to permit a spatial distance d from the light emitting portion 100 of a compact fluorescent light bulb 102. While spacing is beneficial, it should be noted that the fluorescent tube generates little or no heat, depending upon the wattage. The desired shape of the housing can be made to emulate various incandescent bulb types and the spatial distance d is preferably constructed and arranged to provide an area of cushion wherein the housing absorbs a majority of the impact and directs any shock to the bulb base 106. The housing is made out of a rigid translucent thermoplastic polymer such as a polycarbonate which is impact resistant and beneficial for use when the fluorescent light is used in a portable lighting system. Additionally, FEP (perfluoroethylene-propylene copolymer) or PFA (Perfluoroakoxy copolymer) could also be used as they have high temperature ranges and would thus work better with high wattage bulbs. While the housing can provide protection against bulb breakage, should the bulb break then the housing can prevent scattering of the tube which forms the twisted bulb 100. The translucent property can be utilized to achieve the desired transmission of light by limiting the thickness of the housing.

In the preferred embodiment, the housing material may include UV inhibitors so as to prevent the transmission of ultraviolet light through the wall of the housing. The inner surface 14, or the outer surface 22 of the housing, may be frosted so as to allow for an even diffusion of light. Alternatively a prismatic film can be applied along the inner surface allowing for an even distribution of light throughout the housing, including to the lower section 16 which fits over the bulb base 106. In this manner, the distribution of the light can be evenly created from the top 18 of the housing to the bottom 20 providing the appearance of a larger bulb.

The outer surface 22 may also be frosted with a material, or textured, to allow for the receipt of indicia. In such an embodiment, the housing can be decorated with most any item or used for implanting of images that can be projected against the wall. For instance, the housing may be painted or colored with crayons wherein the decorative design will be highlighted by the internal lighting or projected onto an adjoining surface. Depending on the texture applied to the outer surface, the decorative design may be removed and replaced as desired.

The housing 10 consists of a first clamshell 26 which is hingedly coupled to a second clamshell 28. The first and second clamshells are hinged 30 along the top surface 18 by use of a conventional hinge member having a first and second barrel member 32 located on the first clamshell which are operatively associated with a single barrel 34 located on the second clamshell. When the hinge barrels are placed together, they receive a pin 36 to allow traverse pivoting.

Figure 7:
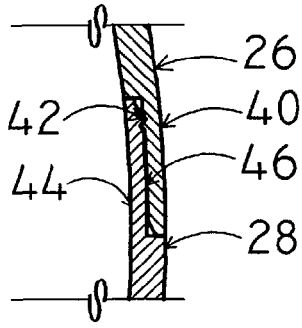
FIG. 7 is a cross sectional view of the clamshell joint.

The first and second clamshells each have an interengaging means for coupling to each other. As shown in FIG. 7 clamshell 26 has a first interengaging tab 40 which projects from a sidewall of the first clam shell and forms a recess 42 for complimentary positioning of an interengaging tab 44 formed on clamshell 28 for complimentary positioning within a recess 46 of the first clamshell section 26.

The interengaging means securely holds the first clamshell 26 to the second clamshell 28 about the base 106 of the compact fluorescent light. The bottom 20 of the housing preferably includes a lip 108 formed from a frictionally engaging material, such as rubber, so as to allow ease of securement to the base 106 without slippage. The lip further provides protection of the bulb during impact by transferring of the impact load from the housing to the base. The use of a rubberized lip aides in the transfer of the shock of impact to the base and further operates to cushion the impact.

The lower end 20 of the housing further includes vent hole 50 to allow for ease of heat dissipation when higher wattage fluorescent lights are employed. Similarly, vent holes are located at the top end 18 of the housing allowing ventilation through the bottom vent 50 to the top vent 52 to accommodate higher wattage bulbs for purposes of heat dissipation.

The use of two clamshells further allows one clamshell to be translucent and the second clamshell to be opaque. This allows the housing to used in areas wherein lighting must be directional by law, or by choice. For instance, it is a law in along certain parts of the coastline that lighting is not directed over the beach during turtle hatching season. The instant cover would allow directional lighting by coupling one opaque clamshell to a transparent clamshell. When lighting is allowed, the cover can be simply rotated. In addition, the opaque cover may be coated with a reflective internal surface thereby enhancing the illumination from a single light.

All patents and publications mentioned in this specification are indicative of the levels of those skilled in the art to which the invention pertains. All patents and publications are herein incorporated by reference to the same extent as if each publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following.

What is claimed is:

1. A cover for a compact fluorescent light comprising:

a housing having an upper section defined by a generally hemispherical shape defining an interior sized to permit a spatial distance between a light emitting portion of a compact fluorescent light bulb and a lower section having a generally circular boundary securable to a base of the compact fluorescent light bulb, said housing formed from a first clamshell shaped section having a first thickness and a second clamshell shaped section having a second thickness;

hinge means pivotally coupling said first clamshell shaped section to said second clamshell shaped section;

first interengaging means integral with and projecting from a sidewall of said first clamshell shaped section;

first recesses integral with and projecting from said sidewall of said first clamshell shaped section;

second interengaging means integral with and projecting from a sidewall of said second clamshell shaped section;

second recesses integral with and projecting from a sidewall of said second clamshell shaped section;

a peripheral resealable lip conforming to the outer perimeter of a lamp fixture and attached to said generally circular outer boundary of said lamp fixture body;

said first interengaging means engaging said second recesses; and said second interengaging means engaging said first recesses, wherein said housing is positioned around said compact fluorescent light with said first and second interengaging means coupling said first clamshell shaped section to said second clamshell shaped second providing a cover that assimilates a conventional incandescent light bulb.

2. The cover for a compact fluorescent light according to claim 1 wherein said lip is a continuous resilient seal for frictionally engaging the base of the compact fluorescent light bulb.

3. The cover for a compact fluorescent light according to claim 1 wherein each said first and said second clamshell is formed from a polycarbonate material.

4. The cover for a compact fluorescent light according to claim 3 wherein said polycarbonate material includes a UV inhibitor to reduce the passage of UV light.

5. The cover for a compact fluorescent light according to claim 1 wherein said housing includes a prismatic film for even distribution of light.

6. The cover for a compact fluorescent light according to claim 1 wherein an outer surface of said housing includes a textured surface for receipt of indicia.

7. The cover for a compact fluorescent light according to claim 1 wherein said housing is translucent.

8. The cover for a compact fluorescent light according to claim 1 wherein one of said first or said second clamshells is opaque.

9. The cover for a compact fluorescent light according to claim 8 wherein said opaque clamshell includes an inner surface having a reflective material.

10. The cover for a compact fluorescent light according,to claim 1 wherein each said first and said second clamshell is formed from perfluoroethylene-propylene copolymer.

11. The cover for a compact fluorescent light according to claim 10 wherein said perfluoroethylene-propylene copolymer includes a UV inhibitor to reduce the passage of UV light and has a predetermined thickness to moderate light passage.

12. The cover for a compact fluorescent light according to claim 1 wherein each said first and said second clamshell is formed from perfluoroakoxy copolymer.

13. The cover for a compact fluorescent light according to claim 12 wherein said perfluoroakoxy copolymer includes a UV inhibitor to reduce the passage of UV light and has a predetermined thickness to moderate light passage.

14. The cover for a compact fluorescent light according to claim 1 wherein said housing is constructed and arranged to allow a predetermined amount of light to pass through.

* * * * *